US005601289A

United States Patent [19]

Hollister

[11] Patent Number: 5,601,289

[45] Date of Patent: Feb. 11, 1997

[54] CHESS PIECE FOR A THREE-DIMENSIONAL VERTICAL STACKING CHESS GAME

[76] Inventor: Lloyd E. Hollister, 809 Llano Trail, Grand Prairie, Tex. 75052

[21] Appl. No.: 543,736

[22] Filed: Oct. 16, 1995

[51] Int. Cl.[6] ..... A63F 3/02

[52] U.S. Cl. ..... 273/290; 273/241; 273/260

[58] Field of Search ..... 273/241, 260, 273/290, 288, 146

[56] References Cited

U.S. PATENT DOCUMENTS 3,608,904 9/1971 Margetson ..... 273/260
3,767,201 10/1973 Harper et al. ..... 273/241
3,794,326 2/1974 Bialek ..... 273/260
3,806,125 4/1974 Bialek ..... 273/260
3,881,731 5/1975 Droney ..... 273/260
4,883,278 11/1989 Scott ..... 273/241

*Primary Examiner*—Benjamin H. Layno
*Assistant Examiner*—Stephen L. Blau
*Attorney, Agent, or Firm*—Ross, Clapp, Korn & Montgomery, L.L.P.

[57] ABSTRACT

A chess piece for a three-dimensional vertical stacking chess game includes a body having a plurality of faces for abutting stacking engagement with a face of another chess piece. Indicia appears on each of the plurality of faces representing a single chess piece. Indicia further appears on each of the plurality of faces representing a vertical level of game play.

14 Claims, 2 Drawing Sheets

CHESS PIECE FOR A THREE-DIMENSIONAL VERTICAL STACKING CHESS GAME

TECHNICAL FIELD OF THE INVENTION

The present invention relates to chess games, and more particularly to a chess piece for a three-dimensional vertical stacking chess game.

BACKGROUND OF THE INVENTION

Heretofore, three-dimensional chess boards used in the play of three-dimensional chess games, were constructed so that each chess board was positioned above, and spaced apart from a lower chess board. The space between the boards was large enough to allow a player's hand to be inserted between the boards in order to move chess pieces around each of the boards. Although three-dimensional chess games provide greater challenges to a chess player, various deficiencies detract from the overall play of such games.

Existing three-dimensional chess games having chess boards spaced apart, make it difficult to observe the correct square to move a chess piece to, so that the chess piece is precisely above or below a particular square on a particular board. For example, when the player is attempting to line a chess piece up on a different board above or below each other, so as to attack an opponent's chess piece, it is difficult to observe the proper square the chess piece should be positioned on. An additional disadvantage of existing three-dimensional chess games is that it is difficult and complicated to move a chess piece between boards. The player must first move a chess piece out to the edge of a board, raise or lower the chess piece to the adjacent board, and then finally insert the chess piece back onto the new board level to the piece's new position on that board. Because of the time required and the physical length of movement of a piece, it is difficult to remember the board level and square the piece is to be positioned on, thereby breaking the player's concentration. Additionally, existing three-dimensional chess games require a significant amount of time to play because of the increased length of time for piece movement.

A further disadvantage of existing three-dimensional chess games is the size of such games, requiring the numerous boards with space between the boards results in a large, cumbersome game which is difficult to transport. A large amount of space is required to play such games, and additional expense in manufacturing is required due to the large number of components necessary to join the multi-boards.

A need has thus arisen for a three-dimensional chess game making it easier to view chess pieces and visually locate each chess piece and their relationship to other chess pieces in a three-dimensional playing environment. A need has arisen for a three-dimensional chess game which eliminates cumbersome play of moving chess pieces between multiple boards by making the game play faster and more challenging to the player.

A need has further arisen for a three-dimensional chess game that is compact, lightweight, and easy to manufacture, requiring no assembly.

SUMMARY OF THE INVENTION

In accordance with the present invention, a chess piece for a three-dimensional vertical stacking chess game is provided. The chess piece includes a body having a plurality of faces for abutting stacking engagement with a face of another chess piece. Indicia appears on each of the plurality of faces representing a single chess piece. Indicia further appears on each of the plurality of faces representing a vertical level of game play.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
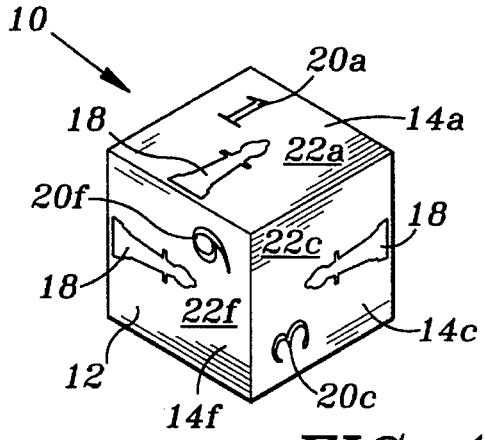
FIGS. 1 and 2 are perspective views of a first embodiment of the present invention.
Figure 2:
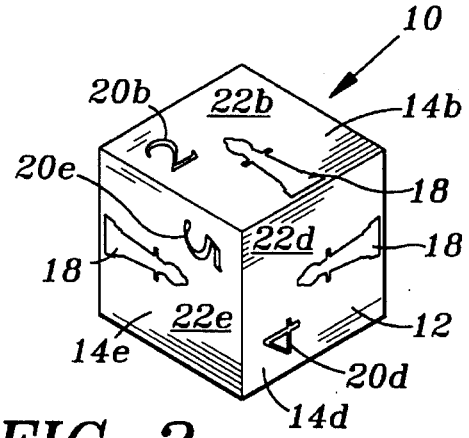

Referring simultaneously to FIGS. 1 and 2, a chess piece in accordance with the present invention is illustrated, and is generally identified by the numeral 10. Chess piece 10 comprises a body 12 in the shape of a regular polyhedron, and more particularly a regular hexahedron, or cube, having six faces 14*a* through 14*f*.

Each face 14 of body 12 includes indicia representing a chess piece, such as for example, indicia 18 representing a Bishop chess piece. The chess piece indicia 18 appears on each face 14 of body 12. Additional chess pieces 10 are utilized to play a chess game, bearing the additional chess piece indicia of King, Queen, Rook, Knight, and Pawn in the appropriate numbers of a conventional chess game for each opponent, totalling 32 pieces.

Also appearing on each face 14 of body 12 is a consecutive numeral 20*a*–20*f* identifying each face on body 12. As shown in FIGS. 1 and 2, numerals 20 range from 1 through 6 representing the six sides of body 12. Numerals 20 represent the vertical level of chess game play in accordance with the present invention. Associated with each numeral 20 is a color 22*a*–22*f* appearing on the surface of each face 14. Each face 14 of body 12 includes a different color 22. Each color 22 represents a different vertical level of chess game play, and allows the user to quickly identify the level of play represented by the top face 14 of body 12.

Body 12 of each chess piece 10 having faces 14 allows pieces 10 to be vertically stacked one atop another. By stacking each chess piece 10, a three-dimensional vertical chess game can be played utilizing the present chess pieces 10. Instead of moving chess pieces vertically on spaced apart chess boards, the present chess pieces 10 are stacked vertically on each other and use a single conventional chess board. The top surface of chess piece 10 exposed to the player represents the vertical stacking level that the piece is placed upon. For example, in FIG. 1, the numeral 1 on face 14*a*, represents a first level of play. If an opponent of a player utilizing the chess piece 10 of FIG. 1, places the chess piece of FIG. 2 on top of surface 14*a* of the chess piece of FIG. 1 thereby making surface 14*b* the top surface on the chess square then a second level of vertical play takes place.

A three-dimensional chess game utilizing the present chess pieces 10 would be played in a conventional manner. Thirty-two chess pieces 10 would be utilized for game play. The face on the top of the chess piece 10 indicates the vertical level of game play. To move a chess piece vertically up or down, body 12 is simply turned to the desired position, identified by numeral 20 as the level of play. Six levels of play is the maximum with piece 10. In conventional three-dimensional chess games, the pieces move in accordance with their predetermined player moves. Such as, for example, the Pawn moves through cell faces when moving longitudinally, laterally or vertically. The Knight moves through faces two cells up or down and one cell over, or one cell up or down and two cells over when moving longitudinally, laterally or vertically. The Bishop moves through cell edges when moving longitudinally and laterally, and moves through cell corners when moving vertically. The Rook moves through cell faces when moving longitudinally, laterally and vertically. The King and Queen can move through cell faces like the Rook, and through cell corners and cell edges like the Bishop.

Using the present chess pieces 10, including numerals 20 and colors 22, players can easily see what vertical level the piece is positioned upon, thus making it easy to view all the chess pieces and their relationship to each other in the three-dimensional chess game. Chess pieces 10 can be easily moved, without the obstructions of multiple vertically stacked chess boards. Vertical movement is simply accomplished by rotating the faces of chess pieces 10.

Figure 3:
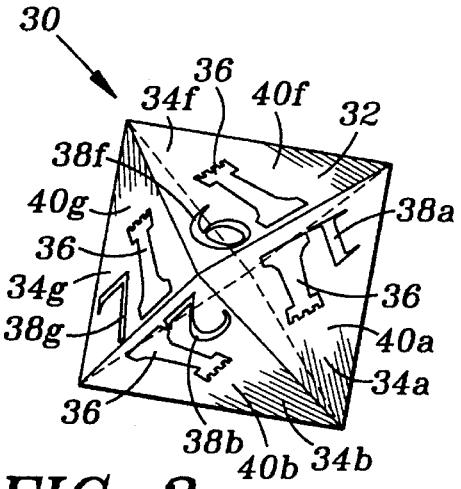
FIGS. 3 and 4 are perspective views of a second embodiment of the present invention.
Figure 4:
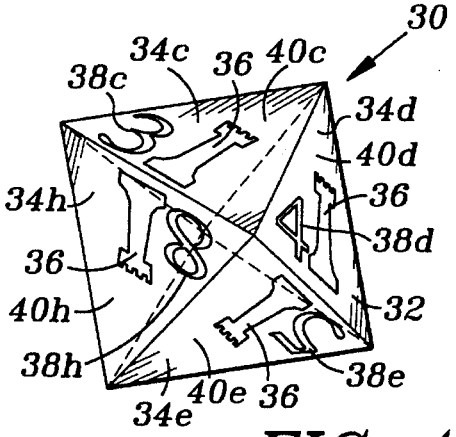

Referring now to FIGS. 3 and 4, an additional chess piece in accordance with the present invention is illustrated, and is generally identified by the numeral 30. Chess piece 30 comprises a body 32 in the shape of a regular octahedron having eight faces 34*a* through 34*h*. Each face 34 includes indicia representing a chess piece, such as, for example, indicia 36 representing a Rook chess piece. Each face 34 includes a consecutive numeral 38*a*–38*h* identifying each of the eight faces of body 32. Further included on each face 34 is a color 40*a*–40*h*, each color being different for each face 34. Chess pieces 30 operate in a vertical chess game similarly to the chess piece 10 of FIGS. 1 and 2, except that an additional two levels of play are available with chess piece 30 thereby providing a vertical chess game having eight levels.

Figure 5:
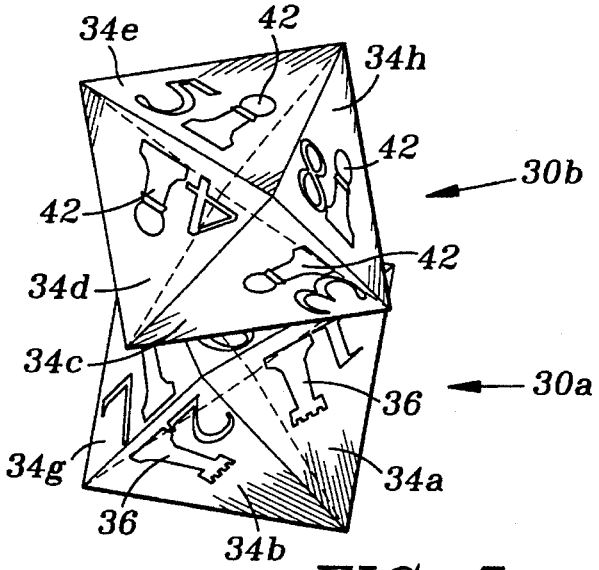
FIG. 5 is a perspective view of the chess piece of FIGS. 3 and 4 shown in a stacking configuration.

Chess pieces 30 are stackable as illustrated in FIG. 5 wherein chess piece 30*b* is stacked upon chess piece 30*a*. The vertical level of play of a chess game is illustrated on face 34e of chess piece 30*b* presenting the fifth level of play. Chess piece 30*a* represents a Rook 36 and chess piece 30*b* represents a Pawn 42.

Figure 6:
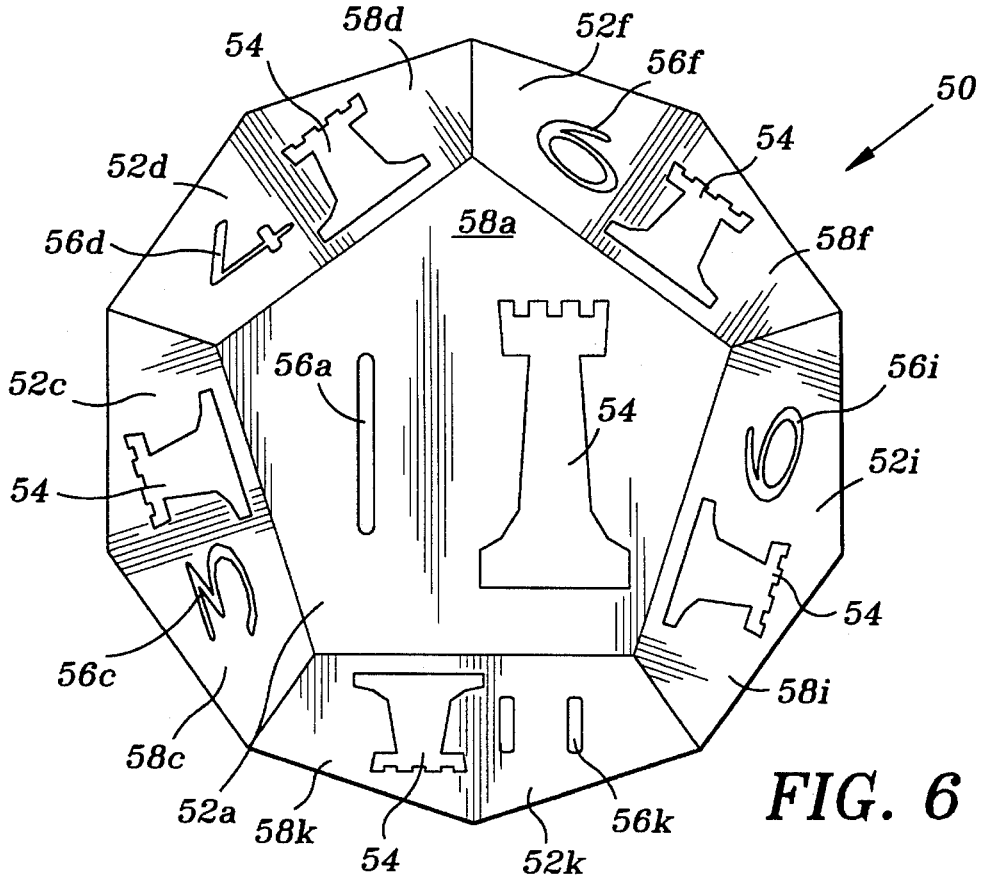
FIGS. 6 and 7 are a top plan view and bottom plan view, respectively, of a third embodiment of the present invention.
Figure 7:
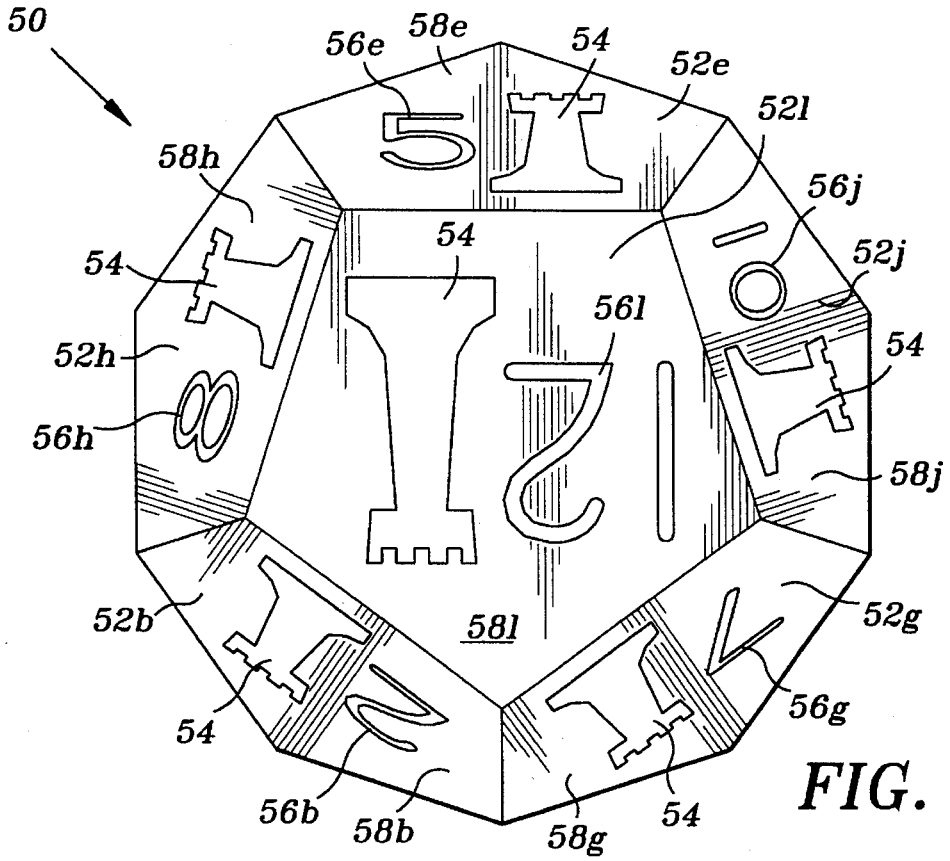

Referring to FIGS. 6 and 7, the present chess pieces can be expanded to include a chess piece 50 in the shape of a regular dodecahedron having twelve faces 52A–52*l* to provide a twelve level vertical chess game. Each of the twelve faces 52 includes indicia representing a chess piece, such as, for example, indicia 54 representing a Rook chess piece. Each of the twelve faces 52 bear a numeral 1 through 12 56A–56*l* representing the twelve levels of vertical play and have twelve different colored faces 58*a*–58*l*.

It therefore can be seen that the present chess piece allows for the play of a three-dimensional chess game resulting in a faster pace, more easily played game, in a more ergonomic environment. The present chess piece allows for a vertical three-dimensional chess game without requiring multiple boards. The present chess pieces allow for a multi-dimensional chess game utilizing a single board, thereby eliminating multiple board components resulting in a game that is small in configuration, compact for travel and storage with fewer parts and thus cheaper to manufacture. The present chess pieces are light in weight, easy to carry and provide for a three-dimensional chess game requiring no assembly of board components.

Whereas the present invention has been described with respect to specific embodiments thereof, it will be understood that various changes and modifications will be suggested to one sided in the art and it is intended to encompass such changes and modifications as fall within the scope of the appended claims.

I claim:

1. A chess piece for a three-dimensional vertical stacking chess game comprising:

a body including a plurality of faces for abutting stacking engagement with a face of another chess piece;

a first indicia appearing on each of said plurality of faces representing a single chess piece; and a second indicia appearing on each of said plurality of faces representing a vertical level of game play, wherein said first indicia is distinguishable from said second indicia.

2. The chess piece of claim 1 wherein said second indicia appearing on each of said plurality of faces representing a vertical level of game play includes a different colored face.

3. The chess piece of claim 1 wherein said second indicia appearing on each of said plurality of faces representing a vertical level of game play includes a different consecutive numeral.

4. The chess piece of claim 1 wherein said second indicia appearing on each of said plurality of faces representing a vertical level of game play includes:

a different colored face; and a different consecutive numeral.

5. The chess piece of claim 1 wherein said body comprises a regular polyhedron shape.

6. A chess piece for a three-dimensional vertical stacking chess game comprising:

a body having a shape of a regular polyhedron including a plurality of faces for abutting stacking engagement with a face of another chess piece;

indicia appearing on each of said plurality of faces representing a single chess piece; and indicia including consecutive numerals appearing on each of said plurality of faces representing a vertical level of game play.

7. The chess piece of claim 6 wherein said indicia appearing on each of said plurality of faces representing a vertical level of game play further includes:

a different colored face.

8. The chess piece of claim 7 wherein said regular polyhedron comprises a hexahedron.

9. The chess piece of claim 7 wherein said regular polyhedron comprises an octahedron.

10. The chess piece of claim 7 wherein said regular polyhedron comprises a dodecahedron.

11. A chess piece for a three-dimensional vertical stacking chess game comprising:

a body having a shape of a regular polyhedron including a plurality of faces for abutting stacking engagement with a face of another chess piece;

indicia appearing on each of said plurality of faces representing a single chess piece selected from the group including: King, Queen, Knight, Bishop, Rook, and Pawn; and indicia including consecutive numerals and an associated different color appearing on each of said plurality of faces representing a vertical level of game play.

12. The chess piece of claim 11 wherein said regular polyhedron comprises a hexahedron.

13. The chess piece of claim 11 wherein said regular polyhedron comprises an octahedron.

14. The chess piece of claim 11 wherein said regular polyhedron comprises a dodecahedron.

* * * * *